US005169254A

United States Patent [19]

Arkwright

[11] Patent Number: 5,169,254

[45] Date of Patent: Dec. 8, 1992

[54] PAPER SHEET FASTENER FILE AND METHOD OF ASSEMBLY

[76] Inventor: George A. Arkwright, 9105 Chickawane Ct., Alexandria, Va. 22309

[21] Appl. No.: 779,237

[22] Filed: Oct. 18, 1991

[51] Int. Cl.[5] ..... B42F 3/00

[52] U.S. Cl. ..... 402/8; 402/60; 402/500; 281/21.1; 462/71; 462/75

[58] Field of Search ..... 283/2, 63.1; 402/80, 402/500, 79, 8, 60; 281/21.1; 462/12, 71, 72, 75

[56] References Cited

U.S. PATENT DOCUMENTS 1,707,326 4/1929 Smiley ..... 402/500
2,799,275 7/1957 Darden ..... 402/80
4,043,573 8/1977 Griffin ..... 283/2
4,530,176 7/1985 Rejwan ..... 40/359

*Primary Examiner*—Timothy V. Eley
*Assistant Examiner*—Willmon Fridie, Jr.
*Attorney, Agent, or Firm*—Shlesinger Arkwright & Garvey

[57] ABSTRACT

This invention relates to a new type of paper sheet file assembly and the method of inserting the individual sheets therein.

A multiple element fastening sheet block initially attached to the file itself provides the capability of immediate placement of a letter or other paper document within the file, without requiring use of other preliminary modifying implements such as a two-hole punch.

20 Claims, 4 Drawing Sheets

PAPER SHEET FASTENER FILE AND METHOD OF ASSEMBLY

FIELD OF THE INVENTION

This invention relates to a new type of paper sheet file assembly and the method of inserting the individual sheets therein.

Conventional file folders for holding correspondence and paperwork use a fastening device such as an acco-binder for holding such papers uniformly in a file. The individual sheets are two-hole punched near the top center edge thereof. The acco-binder prongs, also positioned adjacent the top edge of the backing panel of the file, are opened and the two hole punched sheet is then positioned in the file and the holes placed over the prongs. The upstanding prongs are then bent over to secure the sheet in the file.

This fastening arrangement is both cumbersome and time-consuming, requiring an individual two-hole punch of each letter, the opening of the acco-binder prongs, the actual positioning of the paper sheet in the file over the prongs, and finally the closing of the prongs to hold the sheet in the file. This cumbersome, and time-consuming procedure must be followed for each and every sheet inserted in the file.

This invention makes it possible to avoid this cumbersome procedure, and to rapidly, and accurately place the correspondence in the file, immediately, without any need to adapt the correspondence to be inserted, nor to repeatedly fasten and unfasten holding device such as an acco-binder.

With this new arrangement, each sheet is individually held in the position that it would ordinarily have held where a fastening arrangement, such as an acco-binder used. Consequently, the conventional arrangement of a paper sheet file is unchanged, while the time-consuming manual operations heretofore required for placing a sheet in the file are eliminated.

SUMMARY OF THE INVENTION

The new file arrangement of this invention, because it eliminates a number of operational steps formerly required for placing the correspondence in a correspondence file, makes it possible to immediately insert a paper sheet in a file, thereby saving a considerable amount of effort, annoyance, and most of the time formerly required to place a single sheet in a file folder.

Further, inasmuch as it is unnecessary to repeatedly open and close metal prong fasteners and similar types of devices, there is more inclination to mount file papers in a fixed organized file arrangement with its organized chronological advantages, rather than to have loose papers in a file folder.

A multiple element fastening sheet block initially attached to the file itself provides the capability of immediate placement of a letter or other paper document within the file, without requiring use of other preliminary modifying implements such as a two-hole punch.

Consequently, this file arrangement will not only save time and effort in an organized office, where correspondence is routinely placed in a file using a mechanical fastening device, but will also provide a capability for others, such as individual personal files maintained by an individual, to more readily be kept in an organized fashion, by eliminating the tedious two-hole punch, and fastener devices, ordinarily required to retain such correspondence in a chronological aligned and organized fashion.

These results are readily accomplished with the use of a compact multiple piece fastening sheet block, which after its initial fastening, provides a capability of immediately engage a large number of file sheets that will subsequently be individually placed within the file, without requiring any particular modification of such sheets or opening and closing of mechanical fastening devices.

Further, it is now possible to immediately insert and position the sheet within a file without preliminary marking and centering, frequently required before correspondence is two-hole punched.

With the fastening sheet block any file folder or backing panel will accommodate all file sheets without requiring any modification or adaption of them before they can be received and held in permanent position within the file folder.

Consequently, the fastening sheet lock obviates the need for any auxiliary equipment such as a two-hole punch. It further will save a substantial amount of an office workers time and effort where correspondence and other such papers must be placed in file folders on a regular daily basis.

In summary, the subject invention will substantially reduce the effort heretofore necessary in order to insert and position file sheets in a file folder or jacket, and eliminate the unpleasant task of file sheet preliminary adaptation previously required before such sheets could be inserted and permanently held in a file folder.

These and further advantages of this invention will become apparent to those skilled in the art when taken with respect to the following detailed description of the preferred embodiments.

DESCRIPTION OF THE DRAWINGS

Figure 1:
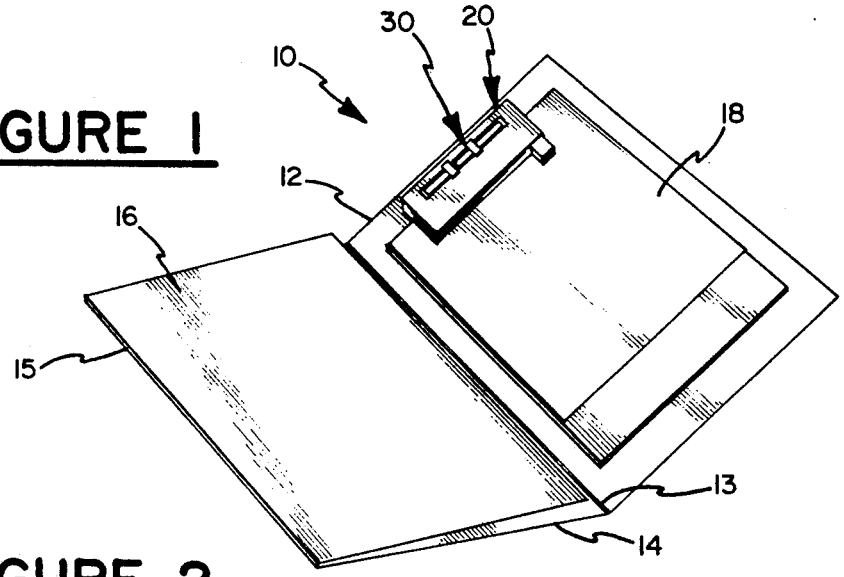
FIG. 1, is a perspective view of a file folder with a fastening block.

Referring particularly to the drawings, FIG. 1 shows a perspective view of a typical type of three panel file folder having a side file sheet backing panel 12, joined along line 13 to middle panel 14, and a top outer panel 16 joining the middle and top panels. The first panel, referred to as the file sheet backing panel is shown with papers mounted thereon, the top paper being a typical 8½×11 sheet of correspondence 18. Fastening block generally indicated at 20, is held in position by a typical fastening or an acco-fastener 30 and provides the ability to hold and fasten the fastening sheets in position on the backing panel 12.

Figure 2:
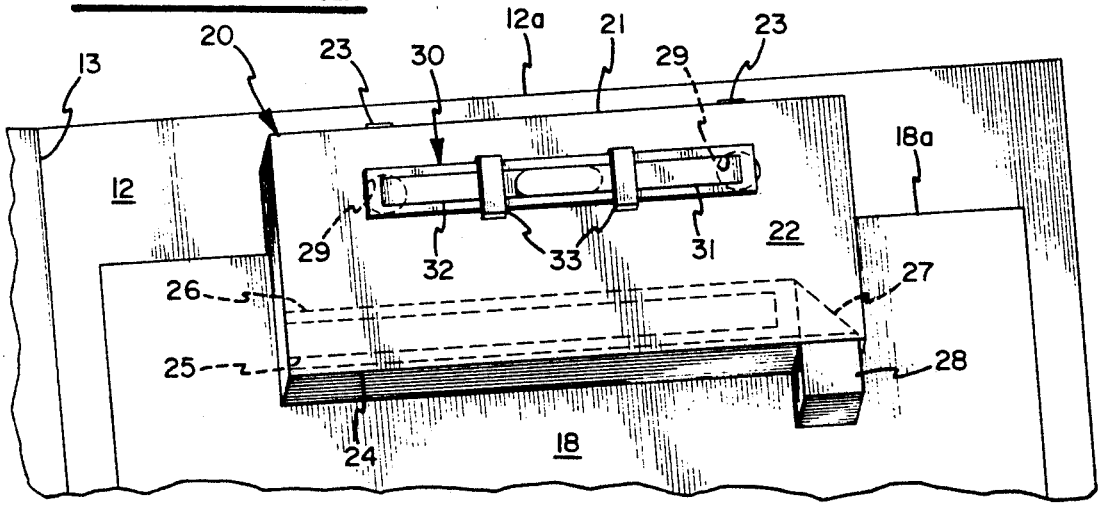
FIG. 2, is an enlarged portion of FIG. 1 showing the fastening block.

FIG. 2 is an enlarged perspective view of the top section of the backing panel showing in greater detail the fastening block 20 and the fastener 30. The fastening block has a set of superposed fastening sheets such as fastener sheet 22 held together by glue tacking strips 23. The fastening sheet 22 is similar in construction to all of the fastening sheets below it. It is a rectangular strip of paper of approximately the same width and thickness as ordinary paper sheet having a file sheet engaging means. A preferred embodiment uses a contact glue assembly. It has a contact glue strip 25 on its undersurface adjacent the lower edge 24 of the fastening sheet, over which a release type covering strip 26 is adhered and then is folded under at 27 adjacent a side edge so that the end of the strip becomes a pull tab section 28 extending below the edge 24.

Figure 3:
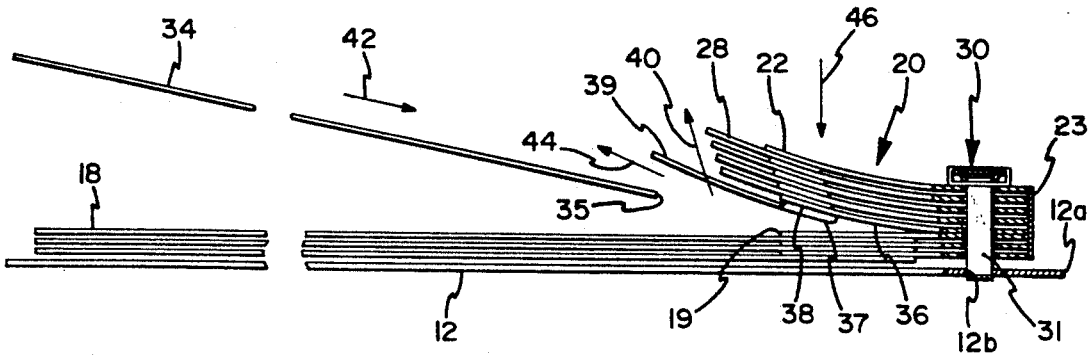
FIG. 3, is an enlarged side view partially cut away of the folder of FIG. 1 illustrating the manner in which a file sheet is inserted in the file folder.

FIG. 3 is an enlarged side view of FIG. 2 showing that each file sheet is connected to an individual fastening sheet, and illustrating the manner in which a new file sheet such as a letter is inserted and held in position by its corresponding fastening sheet.

The manner in which the fastening block and its individual fastening sheets are held in position is shown in FIG. 3. The fastener block is held in position on the backing panel by the fastener assembly 30. The soft metal bendable prongs 31 of the acco-fastener extends upwardly through the holes 12*b* of backing panel 12 and through a pair of spaced aligned holes 29 in each of the superposed fastening sheets of the fastening block 20, as shown in FIG. 3. The long prongs pass through openings in the metal clasp 32, and the prongs 31 are bent inwardly and down into position along the top of the metal clasp 32 to permit slideable lock slides 33 to move into position to hold the fastener prongs down in locked position against the clasp. The cutaway section of FIG. 3 shows how each of the sheets of the fastening block are individually held in position by this arrangement. All of the fastening sheets are each firmly held against the backing panel 12 in one single fastening operation. The holes 29 are prepunched in the fastening block during the course of its manufacture, so that there is no need for a hole punch operation when the block is placed on the file panel.

File sheets such as letters or paper sheets are placed on the panel successively, as desired, each being held in position by its corresponding individual fastening sheet. The last filed letter, 18 is uppermost, and is held in position by its corresponding fastening sheet 19 as shown in FIG. 3.

A fastening block 20 can be fastened to an individual backing panel, or one, or all of the backing panels of the folder, such as the three panel folder of FIG. 1.

When a new letter sheet 34 is to be inserted in the panel, its upper edge 35 is inserted under the lowermost unattached fastening sheet 36, which is moved upwardly to provide the opening into which the edge 35 is inserted and moved up to and close to the binding prongs of the bind-in-acco-fastener 30. The sheet is positioned directly over and in alignment with the upper and side edges of the previously inserted sheets. This is an important advantage of this fastening arrangement. There is no need to have the individual piece of correspondence two-hole punched by the user before the correspondence is placed in the file. Previously, where a letter was to be inserted in the file, it had to be individually two-hole punched. This required that the letter itself be first placed in the file in alignment with the other edges of correspondence already mounted in the file on the panel, and then pencil-marked to show where the two hole punch should be made, to insure that the holes were correctly placed, and its side edges were in direct alignment with the side edges of the other sheets.

Once the sheet 34 is placed in the exact position desired, it is merely held in that position. The lifted fastening strip 36 will then perform the function of firmly locking the letter in that position. The fastening sheet 36 is identical to the fastening sheet 22, which, as previously mentioned, has a contact glue strip 25 along its lower edge, covered by a removing pull of covering strip 26. The fastener pull tab 28 of this strip corresponds to the pull tab 39 of covering strip 37, as shown in FIG. 3. The diagonal 38 corresponds to the diagonal 27 of fastening strip 22.

As illustrated in FIG. 3, when the sheet 34 is to be placed in the file, the lowermost tab 39 is lifted upwardly in the direction shown at 40, the letter 34 is moved in the direction in upwardly and into the opening in the direction of the arrow 40 to place the top edge 35 in position adjacent the prongs 31, and the side edges of the correspondence are brought into direct alignment with the side edge of the sheet 18. The pull tab 39 is then pulled downwardly in the direction of the arrow 44, to expose the glue strip on the lower edge of the fastening sheet 36. After the glue strip or the glue covering for the glue strip on the underside of the fastening sheet 36 is completely removed, the top fastening sheet 22 is pressed downwardly as indicated at 46 to bring the glue strip 38 down and into direct contact with the top surface of letter 34 adjacent its upper edge 35, thereby fastening the letter in position in the file.

Figure 4:
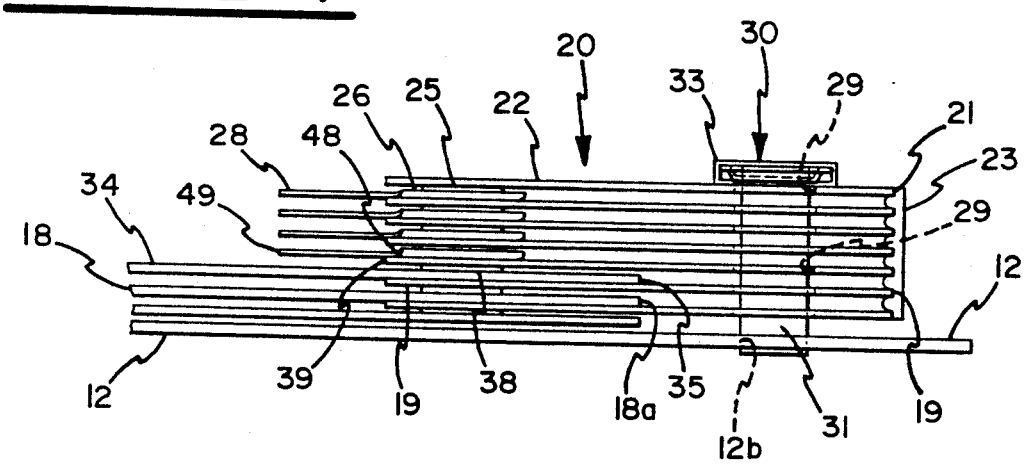
FIG. 4, is a further enlarged side view illustrating the manner in which fastening sheets of the file sheet block and the file sheets are interconnected with each other and the file sheet backing panel.

The enlarged view of FIG. 4 shows the fastening block area of the backing panel and file sheets after letter 34 has been placed in the file. The glue strip 38 which was shown as only a line in FIG. 3 is shown on end, disposed between the lower surface of fastening sheet 36 and the upper surface of letter 34. The next sheet to be placed in the file will be placed under the now lowermost fastening sheet 48 and its pull tab 49. This will be repeated successively until the top fastening sheet 22 is used.

Figure 5:
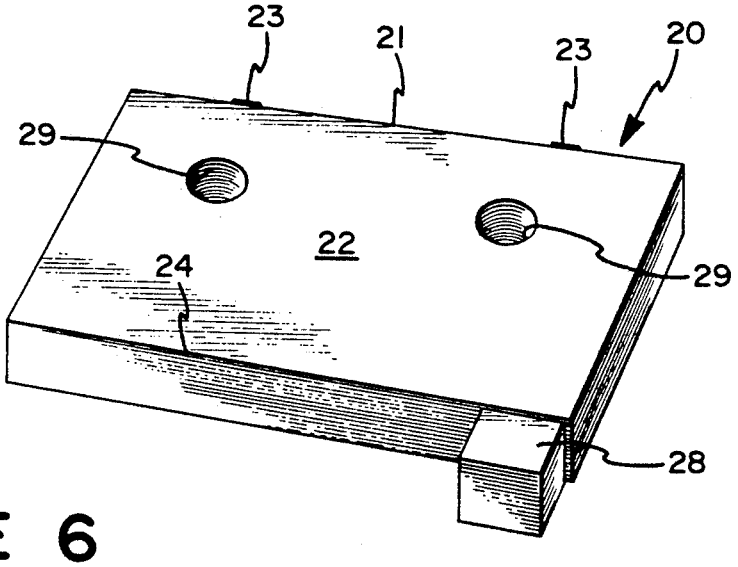
FIG. 5, is a perspective view of the fastening sheet block of FIGS. 1–4.

FIG. 5 shows the fastening block 20. It is a separate individual item which is mounted as an integral single piece on the backing panel. The individual fastening sheets of the block are held together by the binding glue strips 23 extending down the back edge of the block, as illustrated in FIGS. 4 and 5. The strips serve the function of holding the fastening sheets together as a unit for handling purposes prior to the mounting of the block on a backing panel. But, after the fastening block has been inserted in the file, the glue binding strip can easily be separated at any point to permit removal of an individual piece of correspondence from the backing panel. In these cases, the binding strip will also serve to hold the pieces of correspondence or other file material above the removed letter, in alignment, keeping prong receiving holes 29 of all of the other fastening sheets in alignment. This will avoid the frequently troublesome misalignment of the prong receiving holes of the correspondence that often occurs when an intermediate sheet of correspondence is removed from a file.

Figure 6:
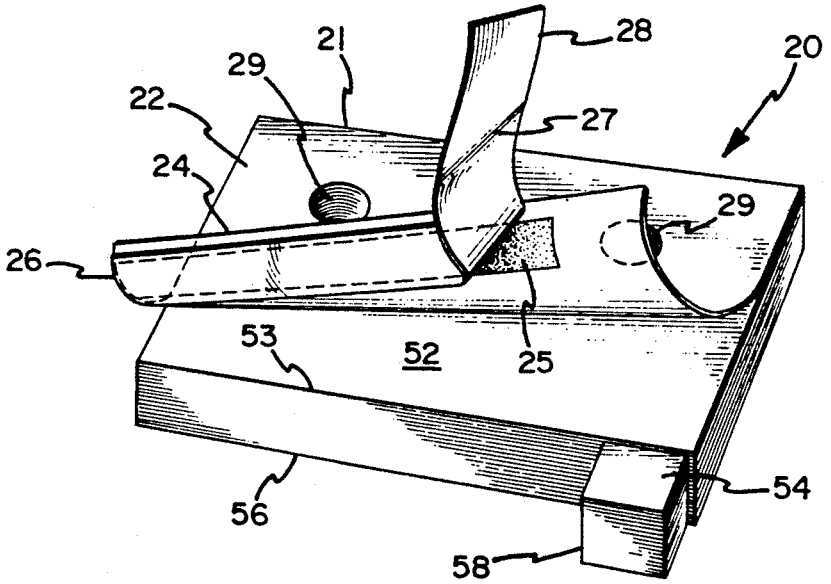
FIG. 6, is a perspective view of the fastener sheet block of FIG. 5 illustrating removal of the glue cover strip from the uppermost fastening sheet of the block.

FIG. 6 is another perspective view of the fastening block 20, showing the underside of the flexible paper fastening sheet 22. The contact glue strip 25 is covered by a removable glue covering strip 26 which has a smooth non-adhering surface to which the contract glue will not strongly adhere. The covering strip 26 is shown as it would appear during the course of this removal, after a letter would have been inserted in position to receive the glue strip 25. The pull tab 28 would be grasped between the thumb and index finger. The diagonal fold line 27 of FIG. 2 is shown separate from the undersurface of the fastening sheet 22. The direct pull of tab 28 will move the covering strip 26 away from the glue section 25 in a peel action that moves along the strip from right to left as shown in FIG. 6.

There may be as many as twenty or thirty fastening strips such as strip 52, beneath fastening strip 22 where the lower edge 53 for example is aligned with the lower edge 24 of fastening strip 22. Similarly, the pull tab 54 of fastening strip 52 underlies pull tab 28. Similarly, edge 56 and pull tab 58 of the lowermost fastening strip are in direct alignment with corresponding fastening strip elements above it. The fastening sheets of the fastening block are used from bottom to top as indicated in the description with respect to FIGS. 3 and 4. The lowermost tab of the block, such as tab 58 in FIG. 6 and tabs 39 and 49 in FIGS. 3 and 4 respectively, are separated by inserting the index finger below the lowermost tab and bending the tabs slightly resulting in the separation of the lowermost tab, so that the thumb can then grasp the top surface of the lowermost tab. A simple pull action will peel the cover strip from the glue surface.

The glue is a strong contact glue of sufficient thickness to engage and firmly stick to the top section surface of the file sheet. The cover strip material is the typical type of folded paper or equivalent having a surface to which the contact glue will not strongly adhere, and of sufficient strength to withstand the pull action of removal without tearing. The typical type of peel off covering material will meet these requirements.

Figure 7:
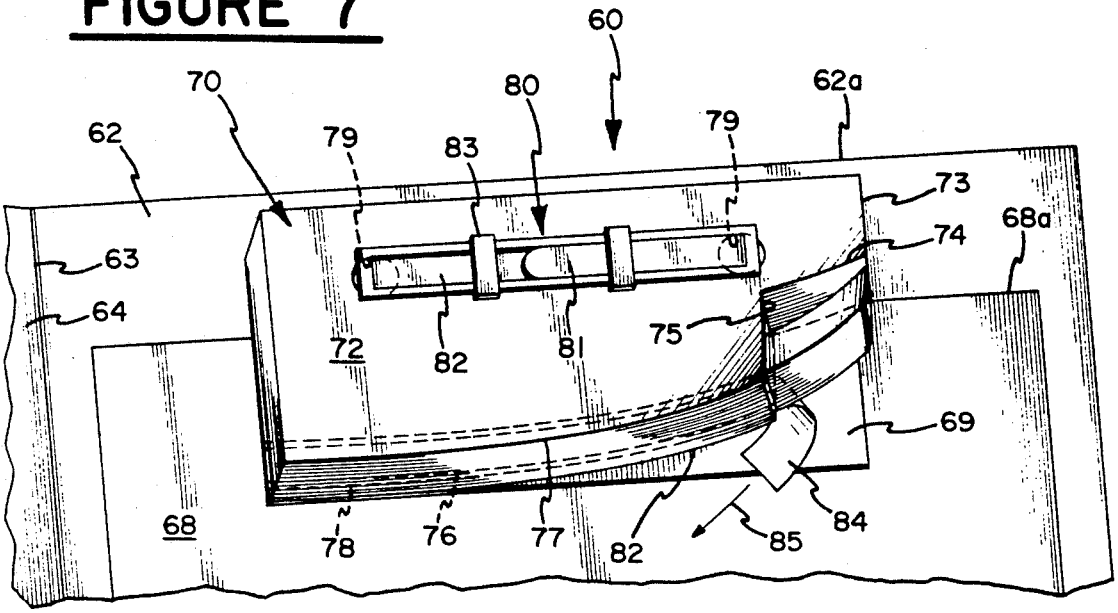
FIG. 7, shows a top partial perspective view of a file folder with another type of fastening sheet block.

FIG. 7 is a perspective enlarged view similar to that of FIG. 2 showing another type of fastening block.

In this embodiment, the file assembly could be a two panel assembly consisting of panel 62 and panel 64 joined along the fold line 63. The second fastening block 70 could also be similarly attached to panel 64 to provide two panels having a capability of immediate receipt and fastening of correspondence and other papers to be mounted on the panel.

Correspondence 68 having its top edge 68A is mounted on the panel parallel to the upper panel edge 62A and within the side edge and the fold line 63, in the same manner as those papers shown in the previous figures.

The fastening block 70 has a plurality of superposed fastening sheets of the same general construction as those discussed previously, with the exception of the pull tab arrangement for the glue covering strip. This configuration of the removal tab is designed for a fastening block that can readily be produced on in-line equipment, with the consequent savings that in-line production of such an item brings.

Figure 8:
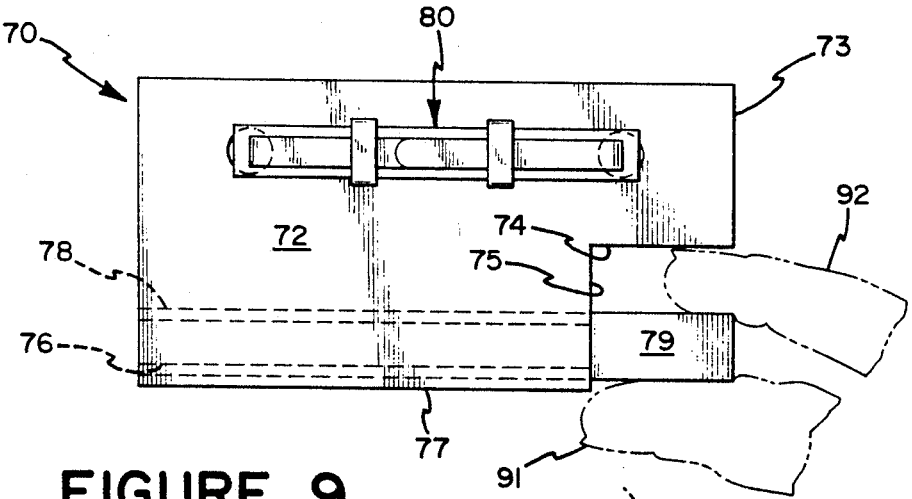
FIG. 8, is a top view of the fastener sheet block of FIG. 7 illustrating the manner of grasping the glue cover strip.

Configuration of the fastening machines and fastening block 70 is illustrated by the top fastening sheet 72 where the right hand edge 73 has the cut-out made by the horizontal line 74 and the vertical line 75. A strip of contact glue 76 is disposed adjacent the lower edge of 77 of fastening sheet 72. It is covered by covering strip 78, shown in dotted outline which has a pull tab section 79 which extends into the cut-out section behind vertical edge 75, as shown in FIGS. 7 and 8.

Figure 9:
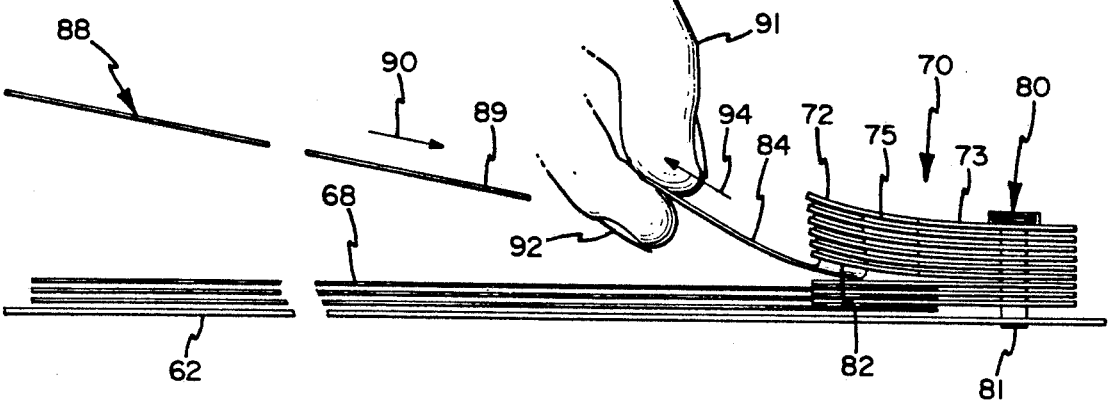
FIG. 9, is a side view of the file assembly of FIG. 7 illustrating the manner of inserting a file sheet in the file assembly.

The lowermost unconnected fastening strip 82, which overlies the last connected fastening strip 69, as shown in FIG. 7 and in FIG. 9. This lowermost unconnected fastening strip is of the same construction as fastening strip 72, and has a glue strip 86 covered by the covering strip 88 having the pull tab 84 at its free end.

The acco-binder assembly 80 has prong section 81 that extends upwardly through the backing panel 62 and through the aligned openings 79 of all of the fastening strips of the fastening block. The prongs 81 and 82 are folded and held in position by the slidable clasps 83.

When a new file sheet is to be inserted in the file, the right index finger is slipped in underneath the pull tabs raising them, and pull tab 84 is then separated, grasped between the thumb and index finger. As shown in FIG. 9, the new sheet of correspondence 88 to be added is moved in the direction 90 so that its upper edge 89 fits into position under the fastening sheet 82 and in alignment with the edges of the previously mounted items. After the letter 88 or other type of paper sheet is in position, the cover strip 88 is removed by pulling the tab 84 in the direction 94 as shown in FIG. 9. The top sheet 72 is then pressed to bring the contact glue strip on the underside of fastening sheet 82 into contact with the upper surface of the sheet 88 adjacent its upper section 89.

The glue strip can be a continuous strip or a series of spaced glue sections disposed in a linear strip. The glue is a conventional type of contact glue that will firmly and readily engage the top surface of an inserted paper sheet.

Figure 10:
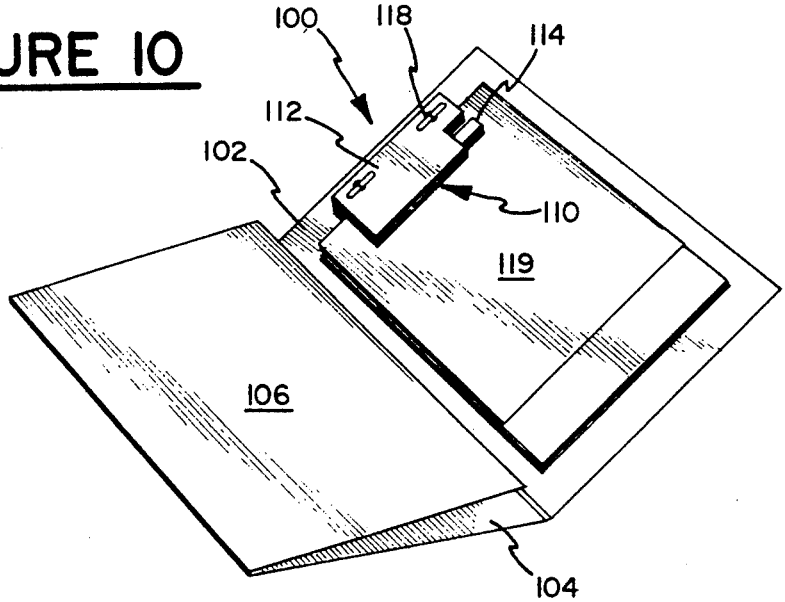
FIG. 10, is a perspective view of the file folder showing the fastening sheet block of FIG. 7 held on the panel by a different type of fastener.
Figure 11:
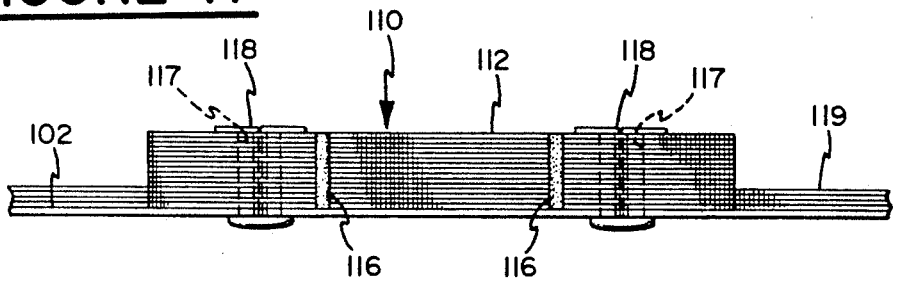
FIG. 11, is an enlarged view of the top of the folder assembly of FIG. 10 showing the vertical glue strips holding the fastening sheets of the block in position; and, FIG. 12, is a perspective view of a file folder assembly using a fastening block of transparent fastening sheets.

A second type of fastening arrangement for the fastening block 70 is shown in FIGS. 10 and 11. A three panel folder generally indicated at a 100 has panels 102, 104 and 106 and as a fastening block 110 it has a plurality of superposed fastening sheets 112, each with a pull tab 114 held in position by individual button fasteners 118 that pass through the aligned openings 117 in the fastening block 110. Two thin, spaced glue spines 116, similar to spines 23 in the earlier figures, lightly hold the fastening sheets together as a block. The correspondence or equivalent type of papers 119 are mounted individually and successively on the backing panel.

Figure 12:
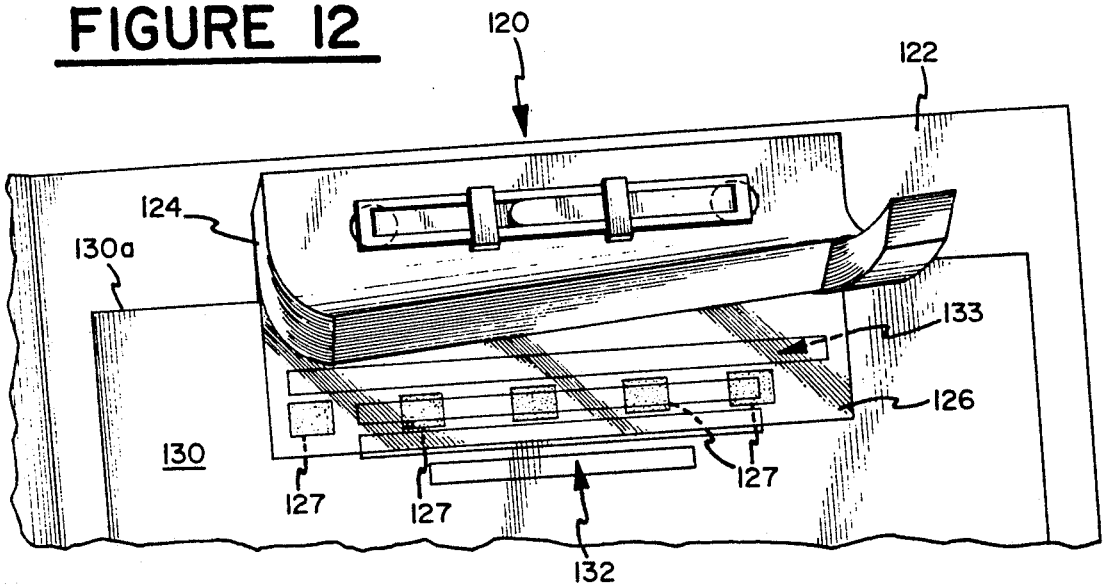

A modification of the fastening block of FIGS. 1–6 as shown in FIG. 12, where, instead of ordinary opaque paper, transparent sheets are used.

The file assembly generally indicated at 120 has a backing panel 122 to which a fastening block 124 is attached with an acco-fastener. Fastening sheets of the block are turned up to show the uppermost and last engaged fastening sheet 126, which is transparent. On its underside are a series of spaced contact glue blocks 127 disposed in a line, which are in engagement with the upper surface of the letter 130. The upper edges 130A is disposed close to the fastener and well under the fastener sheet 126. The letter has a letterhead or other caption 132, that ordinarily would be blocked from view by the opaque material of the fastening strip. However, in this case since the fastening strip is transparent, the covered portion 133 of the letterhead, or other printed material close to the upper edge 130A of the letter 130, is visible through the transparent fastener sheet.

It can readily be seen that the use of such a fastening block is a significant departure from the previous practices of individually punching each sheet, and fastening and unfastening the acco-fastener for each and every sheet to be mounted in the file. The ability to immediately place a piece of correspondence in a file without the distraction of physically modifying it, and then fastening and unfastening the binder, is a very significant advantage.

The ability to do this with an inexpensive fastening block, requiring only simple placement of the sheet before mechanical mounting by glue contact, is a wholly new approach and contradicts what has been accepted for many years as the only correspondence mounting arrangement.

While this invention has been described as having a preferred design, it is understood that it is capable of further modifications, and uses and/or adaptations of the invention and following in general the principle of the invention and including such departures from the present disclosure as come within the known or customary practice in the art to which the invention pertains, and as may be applied to the central features hereinbefore set forth, and fall within the scope of the invention or limits of the claims appended hereto.

I claim:

1. A paper sheet file assembly comprising:

a) a rectangular file sheet backing panel for providing a backing for a plurality of superposed rectangular paper file sheets;

b) a fastening block of relatively small individually superposed thin and substantially rectangular flexible fastening sheets attached adjacent their common upper periphery of the central section of the top edge of the file sheet backing panel;

c) each fastening sheet having fastener engaging means adjacent its upper peripheral edge for receiving a fastener element mounted on the file sheet backing panel;

d) fastener means mounted adjacent the top edge of the file sheet backing panel for engaging the fastener engaging means of the fastening sheets to fasten them to the file sheet backing panel as a block of superposed individual sheets; and, e) paper file sheet engaging means disposed on each fastening sheet adjacent its lower free edge for engaging the top edge of a film sheet, whereby a plurality of successively filed sheets can readily be placed on and integrally fastened to the file sheet backing panel in superposed and aligned relationship by individually inserting them between adjacent fastener sheets and into engagement with the adjacent one of the superposed fastening sheets.

2. The paper sheet file assembly of claim 1, wherein:

a) the file sheet engaging means includes a contact glue section disposed on the lower section of the fastening sheet for engaging a paper file sheet adjacent its upper edge.

3. The paper sheet file assembly as set forth in claim 2, wherein:

a) the contact glue section is disposed on the under surface of the lower section of the fastening sheets.

4. The paper file sheet file assembly as set forth in claim 2, wherein:

a) a removable glue covering piece is disposed over the contact glue section.

5. The file paper sheet file assembly of claim 4, wherein:

a) a pull tab is integral with the glue covering piece which is readily grasped to permit the covering piece to be pulled and removed from the glue section.

6. The paper sheet file assembly of claim 5, wherein:

a) the tab element extends beyond an edge of its respective fastener sheet.

7. The paper sheet file assembly as set forth in claim 1, wherein:

a) the fastening sheet is transparent.

8. The paper sheet file assembly as set forth in claim 1, wherein:

a) the fastener means is a single fastener common to all the securing sheets and is strong enough to hold the securing sheets and the file sheets connected to them firmly mounted on the file sheet backing panel.

9. The paper sheet file assembly as set forth in claim 1, wherein:

a) the file sheet backing panel is one of several panels of a file folder.

10. The paper sheet file assembly as set forth in claim 5, wherein:

a) wherein each of the superposed fastening sheets have a cut-out section adjacent one side thereof; and, b) the pull tab of the glue covering piece extends over said cut-out section to provide a freely extending tab pull section which is readily graspable.

11. A paper sheet filing assembly comprising:

a) a file sheet backing panel which is relatively thick and rigid for supporting paper sheets;

b) a plurality of relatively small superposed fastening sheets attached along a small section of an edge of the backing panel;

c) a plurality of superposed paper file sheets mounted on the panel, each one of the file sheets individually engaging a separate corresponding fastening sheet;

d) the fastening sheets having a small file sheet connecting area which will connect to the edge portion area of a given paper file sheet which is to be placed on the backing panel;

e) each of the paper file sheets having an area smaller than that of the backing panel and a common edge which is disposed parallel to the said edge of the backing panel and relatively close thereto;

f) the common edge of the paper sheets so aligned being in substantial alignment with the corresponding common edges of the other paper file sheets mounted on the panel, and having a common edge section adjacent to the common edge which is connected with the file sheet connecting area of the fastening sheets; and, g) connecting means for connecting the connecting area of the fastening sheets to the corresponding common edge section of the file sheet.

12. The method of making an active correspondence file, comprising:

a) selecting a flat backing panel of relatively stiff rectangular paper material;

b) attaching a block of superposed, flexible fastening sheets to a section of the panel adjacent a periphery thereof;

c) lifting a free edge portion of a fastening sheet containing a file sheet fastening element sufficiently to create an opening to permit insertion of an end portion of a file sheet;

d) inserting the file sheet peripheral edge end portion within the opening and in alignment with the backing panel and the fastening sheet of the fastening element; and e) attaching the file sheet fastening element of the fastening sheet to the file sheet.

13. The method of making an active correspondence file as set forth in claim 12, including the steps of:

a) activating the fastening element by removing a glue cover strip from a glue strip on the engaging portion of the fastener strip to expose the glue surface; and b) pressing the glue surface against the file sheet peripheral edge end portion to thereby engage and hold the file sheet in position in the file.

14. The method of making an active correspondence file as set forth in claim 13, including the step of:

a) grasping a pull tab integral with the glue cover to thereby pull it from the glue section.

15. The paper sheet file assembly as set forth in claim 10, wherein:

a) the fastener means is a single fastener common to all the securing sheets and is strong enough to hold the fastening sheets and the file sheets connected to them firmly mounted on the file sheet backing panel.

16. The paper sheet filing assembly as set forth in claim 11, wherein:

a) the file sheet connecting means includes a contact glue section disposed on the under surface of the lower section of the fastener sheet for engaging a paper file sheet adjacent its upper edge.

17. The paper sheet filing assembly as set forth in claim 16, wherein:

a) a removable glue covering piece is disposed over the contact glue section.

18. The paper sheet file assembly as set forth in claim 17, wherein:

a) a pull tab section is integrally connected to the glue covering piece and is readily grasped to permit removal of the glue covering piece.

19. The paper sheet filing assembly as set forth in claim 18, wherein:

a) each of the superposed fastening sheets have a cut-out section adjacent one side thereof; and, b) the pull tab of the glue covering piece extends over into said cutout section to provide a freely extending tab pull section which is readily graspable.

20. The paper file sheet file assembly as set forth in claim 3, wherein:

a) the glue section is a continuous strip disposed adjacent the lower free edge of the fastening sheet on the under surfaces thereof.

* * * * *